United States Patent [19]

Kellner et al.

[11] Patent Number: 4,473,936

[45] Date of Patent: Oct. 2, 1984

[54] PROCESS FOR MANUFACTURING A PROTECTION AGAINST CORROSION FOR CABLES OF HIGH-STRENGTH STEEL WIRES

[75] Inventors: Urs Kellner, Küsnacht; Otmar Langwadt, Munich; Thomas Herbst, Wessling, all of Fed. Rep. of Germany

[73] Assignee: Dyckerhoff & Widmann Aktiengesellschaft, Munich, Fed. Rep. of Germany

[21] Appl. No.: 311,344

[22] Filed: Oct. 14, 1981

[30] Foreign Application Priority Data

Oct. 15, 1980 [DE] Fed. Rep. of Germany ..... 3038898

[51] Int. Cl.[3] ..... B23P 25/00

[52] U.S. Cl. ..... 29/458; 29/33 K; 29/527.4; 29/745; 29/825; 57/7; 57/232

[58] Field of Search ..... 29/458, 527.4, 460, 29/728, 825, 820, 828, 745, 33 K; 57/232, 7

[56] References Cited

U.S. PATENT DOCUMENTS

| | | | |
|---|---|---|---|
| 1,630,451 | 5/1927 | Ray | 29/458 |
| 2,359,532 | 10/1944 | Searle | 29/828 X |
| 2,676,389 | 4/1954 | Conning | 29/825 X |
| 3,703,034 | 11/1972 | Eilhardt | 29/828 |
| 4,117,582 | 10/1978 | Borelly | 29/458 X |
| 4,192,057 | 3/1980 | Borelly | 29/458 |

FOREIGN PATENT DOCUMENTS

| | | | |
|---|---|---|---|
| 545545 | 6/1942 | United Kingdom | 29/458 |

*Primary Examiner*—Charlie T. Moon

*Attorney, Agent, or Firm*—Toren, McGeady and Stanger

[57] ABSTRACT

For their protection against corrosion, cables of high-strength steel wires, principally for use as tension members for post-stressable earth anchors or rock anchors, are treated with a corrosion protection material and furnished with a tubular sheathing member. In order to be able to surround completely all wires (3, 4) of the cable (2) with corrosion protection material, according to the invention the interior open spaces between the individual wires of the cable are in a first work operation filled with corrosion protection material, and in a second work operation immediately thereafter, when the strand is inserted into the tubular sheathing member, the annular interior open space between the cable and the tubular sheathing member is filled with corrosion protection material. For this purpose, the corrosion protection material is brought into a state of low viscosity and is kept in that state while the interior open spaces are being filled up, whereas afterward it passes over into a state of high viscosity. By this means, not only is the complete filling of the central channels between the interior wire (3) and the exterior wires (4) and consequently a complete protection of also the central wire (3) against corrosion achieved, but also it is assured that the annular space between the cable and the tubular sheathing member is filled completely with corrosion protection material.

12 Claims, 4 Drawing Figures

PROCESS FOR MANUFACTURING A PROTECTION AGAINST CORROSION FOR CABLES OF HIGH-STRENGTH STEEL WIRES

The invention pertains to a process for manufacturing a protection against corrosion in strands or cables of high-strength steel wires, principally for use as tension members for post-stressable earth anchors or rock anchors, in which process each cable after being treated with a corrosion protection material is furnished with a tubular sheathing member.

In all earth anchors and rock anchors that are not used just temporarily, the steel tension members must be durably protected against corrosion. Whereas hot-rolled steel bars are less susceptible to corrosion, not only because of their alloy content but also because of their cross-sectional shape, and besides are relatively easy to protect against corrosion, in the case of strands or cables of steel wires a durable protection against corrosion is as necessary as it is difficult to achieve.

In general, such strands or cables are multi-wire cables made up of usually seven steel wires: one central wire and six outer wires arranged around it, each wire having its circular cross-sectional area. By twisting the wires are plastically deformed so that they retain their densely compacted state.

In a known process, multi-wire steel cables are coated on their surface with a corrosion protection material (for example, a lubricant) immediately after the cable is formed, in a continuous process. The cable which has been thus coated is inserted into a sheathing tube or a sheathing tube is extruded onto it to assure mechanical protection.

This process can be utilized when corrosion protection is required along the entire length of the cable or strand. In earth anchors and rock anchors, however, the anchoring segment, which makes up a considerable portion of the overall length of the tension member, must be free of all lubricant, since such material prevents the bonding action with the cement mortar which transmits the anchoring force. If cables protected in this way against corrosion are used, in the anchoring region the lubricant must be removed by comparatively expensive measures, such as boiling off or by steam jets and the like. Even without the fact that the lubricant is not always successful if the work is carelessly performed, much waste and dirt result when the protective sheath is taken off and the lubricant removed.

Quite apart from this, however, there is the general problem in applying corrosion protection material to a cable that, when only the surface of the cable is coated, the central wire within the cable (such as where a seven-wire cable is used) is not touched by the corrosion protection material. Further, when the coated cable is inserted into a sheathing tube or the sheathing tube is extruded onto the cable, it cannot be assured that the annular space between the cable and the sheathing tube is completely filled. It being impossible to treat the central wire within the cable, the result is not only that this wire is not protected, but also that there are small channels around this central wire which are not completely filled, so that under certain conditions they can channel water along the length of the anchoring member from one side to the other side of a structure.

The object of the invention is to provide a method of not only protecting the central wire against corrosion, but also filling completely the annular space between the cable and the inside surface of the tubular sheathing member.

In accordance with the invention this object is achieved by the following means: In a first work operation, the interior open spaces between the individual wires of the cable are completely filled with corrosion protection material, and then, in a second work operation immediately following the first, the cable is inserted into a sheathing tube member in which the space between the cable and the interior surface of the sheathing tube is completely filled with corrosion protection material.

It is to the purpose for the corrosion protection material for filling up the interior open spaces to be brought into a state of low viscosity, e.g., liquefied, and kept in that state while the open spaces are being filled. After that it passes into a state of high viscosity, e.g. solidifies.

The corrosion protection material can be liquefied by heating; or, if it has thixotropic characteristics, it can be liquefied by agitation.

To fill the interior open spaces between the individual wires in the cable, the cable is conducted through a bath of the liquefied corrosion protection material. It is advantageous for the cable to pass through this bath dipping in the shape of a catenary.

It is also possible, before the cable is inserted into the tubular sheathing member, for the member to be filled with corrosion protection material so that as the cable is inserted at one end an amount of the material corresponding to the volume of the cable is expelled at the opposite end of the tubular sheathing member.

Finally, it is possible to inject the corrosion protection material under pressure into the open spaces between the individual wires of the cable.

To fill the annular space between the cable and the tubular sheathing member, before the insertion of the cable the member can at least partially be filled with corrosion protection material. As the cable is inserted at one end of the sheath, any excess of corrosion protection material issues at the opposite end.

An advantageous method is, while the cable is being inserted into the tubular sheathing member, to fill the member under pressure with corrosion protection material. At the same time, a portion of the length of the sheathing member can be completely filled with corrosion protection material so that the material is distributed over the entire length of the sheathing member as the cable is inserted.

It is also possible to apply a layer of the corrosion protection material along the inside surface of the tubular sheathing member before the cable is inserted into it.

An intrinsic feature of the process according to the invention is that, on the one hand, by special measures the interior or central channels within the cable are filled and so the treatment of the central wire is accomplished, and on the other hand, in a separate work operation, the annular space between the cable and the tubular sheathing member is filled with corrosion protection material.

Generally, lubricants, waxes or similar materials are used for corrosion protection. In the cold state, these substances have a high viscosity, i.e., a high internal friction. The viscosity can be reduced by heating, with a reduction in internal friction, so that the corrosion protection material penetrates of itself into the small interior channels within the cable when the cable is passed through a bath of the material. This last effect is aided by the continuing deformation of the cable as it passes through the bath assuming a catenary shape.

If the corrosion protection material is thus liquefied it is also possible by means of a simple pump to fill the tubular sheathing member before the cable is ineerted into it. Any excess corrosion protection material can be expelled out of the sheathing member at the end opposite where the cable is inserted and the excess material can be recovered. The internal friction in the corrosion protection material which has been liquefied by heating is so small that even very long cables can be inserted without any difficulty into the sheathing member in this manner. As a result, the annular space between the inner surface of the sheathing member and the cable can be completely filled with the corrosion protection material and the material, after cooling, again assumes the high viscosity of a lubricant.

The technical advantages in the practical application of the corrosion protection material with low viscosity can also be achieved by applying pressure to reduce the internal friction. Thus it is also possible according to the invention for the corrosion protection material to be introduced under pressure into the interior open spaces between the individual wires of the cable as well as into the annular space.

In all these cases the invention makes it possible in a continuous process to apply the corrosion protection not all the way along the length of the cable but only on portions of the length thereof, so that it is not necessary to remove the corrosion protection again from tension members in the anchoring regions.

Further features of the invention and advantages achieved by means of them are evident from the following description of the drawing. The following are shown.

Figure 1:
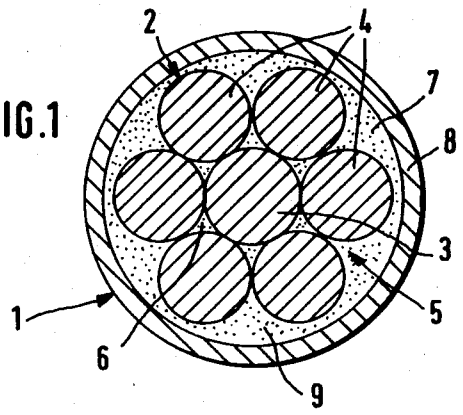
FIG. 1 is a transverse cross-sectional view of a cable furnished with corrosion protection according to the invention, ready to be inserted.

Shown in FIG. 1 is a transverse cross-sectional view of a cable which in accordance with the invention has been furnished with full corrosion protection and in this form is suitable, for example, as a tension member 1 for an earth anchor or rock anchor. The cable 2 itself is made up of a central wire 3, around which a total of six outer wires 4 are grouped. The diameters of the outer wires 4 are somewhat smaller than the diameter of the central wire 3, so that between the individual outer wires 4 there remain narrow interspaces which lead to channels 6, the so-called central channels. As viewed in cross-section in FIG. 1, these central channels 6 have the shape of a wedge, and wedges also extend the annular empty space 7 which is situated between the cable 2 and a tubular sheathing member 8 surrounding the cable 2. The central channels 6 and the annular space 7 are completely filled with a corrosion protection material 9. Cables to be treated according to the invention can, of course, have any number of wires varying from the number of wires in the arrangement shown.

Figure 2:
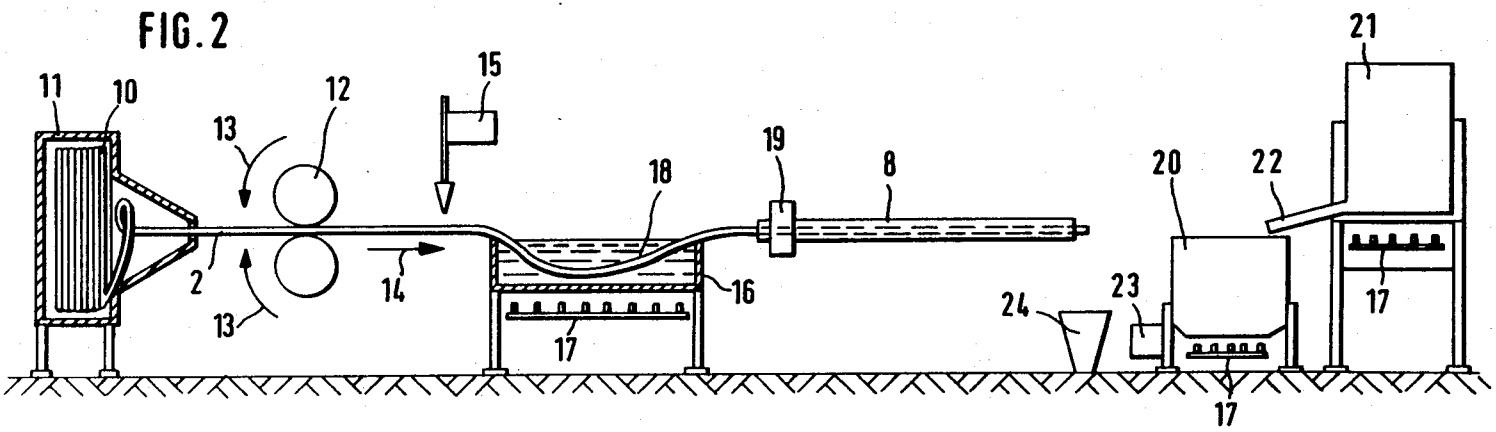
FIG. 2 is a schematic showing of an apparatus for carrying out the process according to the invention with corrosion protection material which has been liquefied by heating.

Pictured schematically in FIG. 2 is an apparatus with which the central channels 6 and the annular empty space 7 can be completely filled with corrosion protection material 9. In this apparatus, the cable 2 to be treated is unwound from a coil 10 which is supported in a mounting 11, and the cable 2 is conducted by means of a pushing-in tool which is represented only schematically by its drive rollers 12. By means of the rollers 12, which turn in the direction of the arrows 13, a pushing force acting in the direction of the arrow 14 is applied to the cable 2.

The cable 2 then passes a cutting tool 15, with which individual pieces of the cable can be cut off as required.

Subsequently, the cable 2 passes through a container 16 containing corrosion protection material which has been liquefied by the effect of e.g. a gas flame heating 17 to become a bath 18. The cable 2 passes across the bath, sagging downward unsupported in a catenary form in the bath. Within the bath 18, the central channels 6 between the individual cable wires 3 and 4 are filled completely. Immediately after the cable 2 has left the bath 18 it is inserted into the tubular sheathing member 8 by means of guideways, not shown. The sheathing member 8 rests on a base support plate, not shown, and is held at least at the end face of the sheathing member by a holder 19. If necessary, additional intermediate holders can be provided along the length of the sheathing member 8.

The sheathing member 8 is already filled with liquid corrosion protection material when the cable 2 is inserted into the sheathing member 8. The corrosion protection material is kept available in a mixer 20 which can also be heated e.g. by means of a gas flame heating apparatus 17, the corrosion protection material being conveyed to the mixer 20 from an also heatable vat 21 via an outlet conduit 22. From the mixer 20 the corrosion protection material is pumped through a conduit, not shown, into the tubular sheathing member 8. As the cable 2 is inserted into the tubular sheathing member 8, the cable 2, lubricated by the liquid corrosion protection material, slides through, and in this process the excess corrosion protection material corresponding to the volume of the cable is collected in a container 24 at the end of the tubular sheathing member 8.

Figure 3:
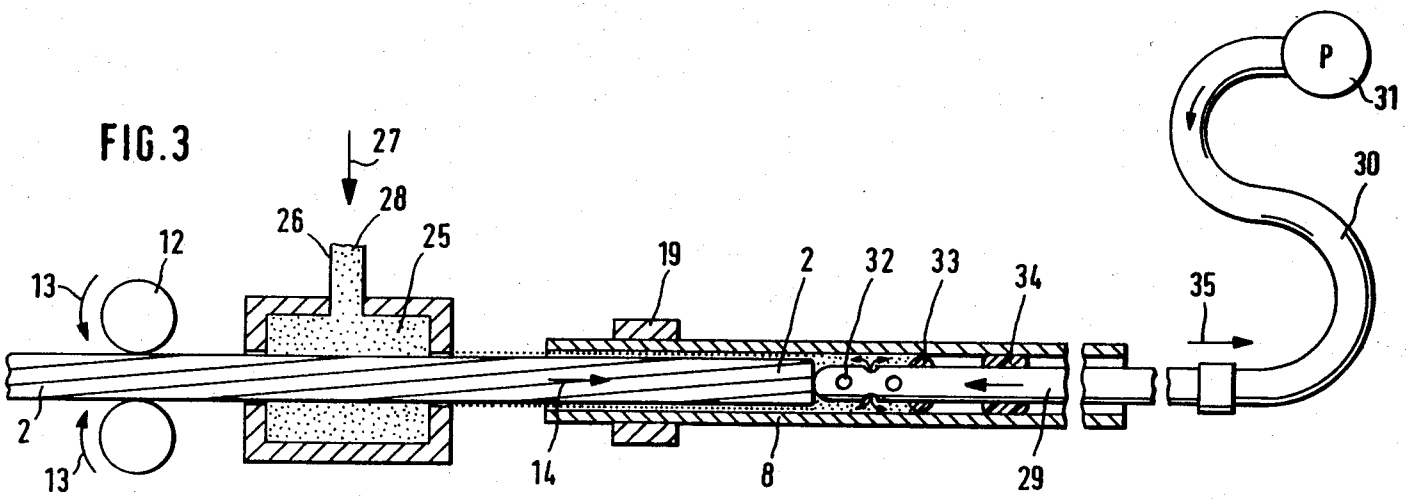
FIG. 3 is a schematic showing of an apparatus for carrying out the process according to the invention with the application of pressure.

In the apparatus schematically represented in FIG. 3, the cable 2, after passing the rollers 12 of an insertion tool which in turn generates a thrust in the direction of the arrow 14, is conveyed through a pressure housing 25, into which corrosion protection material 28 is forced through a pipe socket 26 in the direction of the arrow 27. The force pressing in must be so high that as the cable 2 passes through the pressure housing 25 it is certain that the central channels 6 are filled with corrosion protection material.

Immediately after the cable 2 exits from the pressure housing 25, it is pushed into the tubular sheathing member 8. A pressure tube 29 extends into the tubular sheathing member 8 (which is in turn supported in a holder 19), and this pressure tube 29 is connected via a pressure hose 30 to a pump 31 by means of which the corrosion protection material can be conveyed at high pressure. The pressure tube 30 is provided at its front end with apertures 32 through which the corrosion protection material can issue into the sheathing member 8. The pressure tube 30 is centered within the sheathing member 8 by means of cams 33. By means of a seal 34 the annular space between the pressure tube and the sheathing member is sealed rearwardly.

Before the cable 2 is inserted into the tubular sheathing member 8, the pressure tube 30 is inserted at the member's 8 opposite (downstream) end. Also before insertion of the cable 2, corrosion protection material is injected into the tubular sheathing member 8. When the cable 2 is pushed into the sheathing member 8 in the direction of the arrow 14 and in the process displaces the pressure tube 29 in the direction of the arrow 35 out of the sheathing member 8, the corrosion protection material issuing from the apertures 32 fills the annular space between the pressure tube and the sheathing member and also the (narrower) annular space between the cable 2 and the sheathing member 8. During this step, any excess corrosion protection material is pressed out at the opposite end of the tubular sheathing member.

Figure 4:
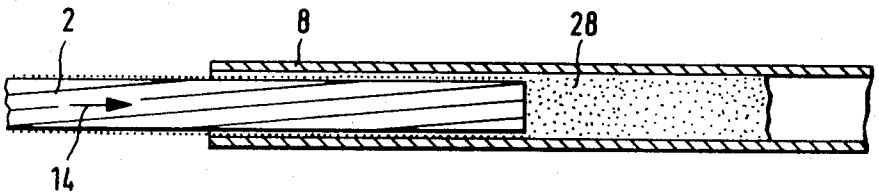
FIG. 4 is a schematic showing of a variation of the apparatus shown in FIG. 3.

In FIG. 4 a variation of the apparatus in FIG. 3 is illustrated. The device for filling up the interior spaces 6 between the individual wires of the cable does correspond to that described relative to FIG. 3. In the present instance, however, in order to fill completely the annular space between the cable 2 and the tubular sheathing member 8, the tubular sheathing member 8 is filled with corrosion protection material for a given length in the region of the entry end so that the material forms a kind of plug. The thrust force exerted by the insertion tool must be so great that when the cable 2 is inserted the plug of corrosion protection material is pushed along in front of the cable 2. The quantity of corrosion protection material, that is to say, the length of this plug, must be so great that the annular space along the entire length of the tubular sheathing member 8 is completely filled. This can be verified by checking whether a certain quantity of corrosion protection material issues at the opposite end, not represented, of the tubular sheathing member.

We claim:

1. Method of producing a corrosion protection on cables of high-strength steel wires, principally for use as tension member for post-stressable earth anchors or rock anchors, where the cable comprises a central wire (3) and a plurality outer wires (4) twisted around and in contact with the central wire so that wedge shaped channels (6) are formed between the central wire and the outer wires in which method each cable after treatment with a corrosion protection material is furnished with a tubular sheathing member, characterized in that, in a first work operation, with the outer wires twisted around the central wire, completely filling the interior open channels (6) between the central wire (3) and the outer wires (4) of the cable (2) with corrosion protection material (9), and then, immediately following the first work operation, in a second work operation, inserting said cable into said tubular sheathing member, and completely filling the annular empty space (7) between the outer wires (4) of said cable (2) and the interior of said tubular sheathing member (8) with corrosion protection material (9).

2. Method according to claim 1, characterized in that by treating the corrosion protection material used for filling up said interior open channels by bringing the material into a state of low viscosity, e.g. liquefied, and maintaining the low viscosity state while filling said interior open channels, and afterward treating the corrosion protection material and converting it, into a state of high viscosity, e.g., solidifies.

3. Method according to claim 2, characterized by heating the corrosion protection material to a liquefied state so that it has a low viscosity.

4. Method according to claim 2, characterized in that the corrosion protection material exhibits thixotropic characteristics and liquefying the corrosion protection material by agitation.

5. Method according to one of the claims 2 to 4, characterized therein by conducting said cables (2) through a bath of liquefied corrosion protection material for filling up the interior open channels between said control wire and said outer wires.

6. Method according to claim 5, characterized therein by arranging said cables (2) in the shape of a catenary while conducting the cables through said bath.

7. Method according to one of the claims 2 to 4, characterized therein by filling each said tubular sheathing member (8), before insertion of said cable (2), with corrosion protection material, while inserting said cable into one end of said tubular sheating member expelling from the opposite end of the tubular sheathing member the quantity of corrosion protection material corresponding to the volume of said cable.

8. Method according to claim 1 or 2, characterized therein by forcing the corrosion protection material under pressure into said interior open spaces (6) between said central wire (3) and said outer wires (4) of said cable (2).

9. Method according to claim 8, characterized therein by filling at least partially with corrosion protection material the interior of the tubular sheathing member before inserting the cable, and expelling any possible excess of corrosion protection material when said cable is passed through the tubular sheathing member out at the opposite end of said tubular sheathing member from which the cable enters.

10. Method according to claim 9, characterized therein by filling under pressure corrosion protection material into said annular interior open space 7 between said cable (2) and said tubular sheathing member (8) simultaneously with the insertion of said cable (2) into said tubular sheathing member.

11. Method according to claim 10, characterized therein by completely filling said tubular sheathing member (8) for a part of its length with corrosion protection material, and distributing the corrosion protection material over the entire length of the tubular sheathing member.

12. Method according to claim 8, characterized therein by applying a layer of corrosion protection material along the inner circumference of said tubular sheathing member (8) before inserting the cable into the tubular sheathing member.

* * * * *